US007975403B2

(12) United States Patent
Mosher

(10) Patent No.: US 7,975,403 B2
(45) Date of Patent: Jul. 12, 2011

(54) FOOTWEAR WITH PIVOTING TONGUE

(75) Inventor: John Mosher, Hopkinton, MA (US)

(73) Assignee: Mercury International Trading Corporation, North Attleboro, MA (US)

( * ) Notice: Subject to any disclaimer, the term of this patent is extended or adjusted under 35 U.S.C. 154(b) by 945 days.

(21) Appl. No.: 11/973,529

(22) Filed: Oct. 9, 2007

(65) Prior Publication Data

US 2009/0090026 A1 Apr. 9, 2009

(51) Int. Cl.
*A43B 23/26* (2006.01)

(52) U.S. Cl. ..... 36/51; 36/54

(58) Field of Classification Search ..... 36/51, 50.1, 36/54, 72 R, 96
See application file for complete search history.

(56) References Cited

U.S. PATENT DOCUMENTS

| | | | | |
|---|---|---|---|---|
| 599,341 | A | 2/1898 | Meeter | |
| 806,267 | A | 12/1905 | King | |
| 1,328,333 | A * | 1/1920 | Mann | 36/50.1 |
| 2,712,185 | A | 7/1955 | Corrigan | |
| 2,829,449 | A | 4/1958 | Edwards et al. | |
| 2,851,798 | A | 9/1958 | Phillips | |
| 3,334,427 | A * | 8/1967 | Edwards et al. | 36/72 R |
| 3,470,630 | A * | 10/1969 | Ott et al. | 36/72 R |
| 3,841,004 | A | 10/1974 | Gray et al. | |
| 3,952,430 | A * | 4/1976 | Pankin et al. | 36/51 |
| 3,995,382 | A | 12/1976 | Smith | |
| 3,997,983 | A | 12/1976 | Terhoeven | |
| 4,069,599 | A | 1/1978 | Alegria | |
| 4,130,949 | A | 12/1978 | Seidel | |
| 4,258,482 | A * | 3/1981 | Salomon | 36/118.5 |
| 4,270,285 | A * | 6/1981 | Antonious | 36/50.1 |
| 4,599,811 | A | 7/1986 | Rousseau | |
| 4,817,303 | A | 4/1989 | Selbiger | |
| 5,154,011 | A | 10/1992 | Holzl et al. | |
| 5,313,719 | A | 5/1994 | Koethe | |
| 5,329,432 | A | 7/1994 | Bland | |
| 5,394,312 | A | 2/1995 | Bland | |
| 5,459,947 | A | 10/1995 | Lasher | |
| 5,566,477 | A | 10/1996 | Mathis et al. | |
| 5,701,688 | A | 12/1997 | Crowley | |
| 5,933,985 | A * | 8/1999 | James | 36/50.1 |

(Continued)

FOREIGN PATENT DOCUMENTS

| | | |
|---|---|---|
| GB | 1275384 | 5/1972 |

OTHER PUBLICATIONS

International Search Report and Written Opinion from corresponding PCT application No. US08/00665 mailed Jul. 25, 2008.

*Primary Examiner* — Marie Patterson
(74) *Attorney, Agent, or Firm* — Wolf, Greenfield & Sacks, P.C.

(57) ABSTRACT

Footwear is provided having a tongue pivotally coupled to the footwear upper. The tongue may be constructed to pivotally move relative to the upper between a first position and a second position. At least one resilient member may be coupled to the tongue for urging the tongue in either the first position or the second position. The tongue may be a spring-loaded tongue such that when the tongue is positioned in an intermediate position between the first and second position, the tongue will spring towards either the first position or the second position.

31 Claims, 11 Drawing Sheets

U.S. PATENT DOCUMENTS 6,199,305 B1 * 3/2001 Steuerwald et al. ..... 36/50.1
6,378,230 B1 4/2002 Rotem et al.
6,408,542 B1 * 6/2002 Shepherd ..... 36/54
6,681,503 B2 1/2004 Morle
6,941,681 B2 9/2005 Pritchett
6,971,192 B2 12/2005 Shepherd
7,207,126 B2 4/2007 Gantier
7,318,290 B2 * 1/2008 Jones et al. ..... 36/54
7,392,603 B1 * 7/2008 Shepherd et al. ..... 36/54
7,685,747 B1 3/2010 Gasparovic et al.
2002/0029496 A1 3/2002 Morle
2002/0170205 A1 * 11/2002 Shepherd ..... 36/54
2002/0194749 A1 * 12/2002 Jones et al. ..... 36/54
2004/0187351 A1 9/2004 Jones et al.
2005/0223598 A1 * 10/2005 Jones et al. ..... 36/54
2009/0217552 A1 * 9/2009 Paintin et al. ..... 36/138

* cited by examiner

FOOTWEAR WITH PIVOTING TONGUE

FIELD OF INVENTION

The present invention relates to footwear and more particularly to footwear having a tongue pivotally coupled to the footwear upper.

BACKGROUND OF THE INVENTION

A tongue is conventionally located on an instep portion of footwear and it may both cover and protect portions of the foot. The tongue may also prevent shoe laces from rubbing on the foot. Typically, a footwear tongue is made of a flexible fabric material and it may be made with the same material as the footwear upper. In some instances, the tongue may include a foam material to provide cushioning properties. Often, shoe laces extend over the tongue, keeping the tongue in a substantially stationary position when the footwear is worn on a foot. When the laces are untied, the wearer may flex the tongue into a different position to assist in the insertion of the foot into or the removal of the foot from the footwear.

SUMMARY OF INVENTION

In one illustrative embodiment, footwear is provided which includes an upper constructed to support a top portion of a foot and a tongue pivotally coupled to the upper. The tongue is constructed to pivotally move relative to the upper between a first position and a second position. The footwear further includes at least one resilient member coupled to the tongue for urging the tongue in at least either the first position or the second position.

In another illustrative embodiment, footwear is provided which includes an upper constructed to support a top portion of a foot and a sole coupled to the upper and constructed to support a bottom portion of a foot. The footwear further includes a spring-loaded tongue pivotally coupled to the upper and the tongue is constructed to pivotally move relative to the upper between a first position and a second position, such that when the tongue is positioned in an intermediate position between the first and second position, the tongue will move towards at least either the first position or the second position.

In yet another illustrative embodiment, footwear is provided which includes an upper constructed to support a top portion of a foot and a tongue pivotally coupled to the upper along a hinge. The tongue is constructed to pivotally move relative to the upper between a first position where the tongue extends substantially along an instep portion of the upper and a second position where the tongue extends substantially along a toe portion of the upper. The footwear further includes at least one resilient member extending from a first fixed location on a medial side of the footwear to a second fixed location on the tongue and to a third fixed location on a lateral side of the footwear. As the tongue pivotally moves from the first position to the second position, the at least one resilient member pivotally moves over the hinge.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

In the drawings, each identical or nearly identical component that is illustrated in various figures is represented by a like numeral. For purposes of clarity, not every component may be labeled in every drawing.

Various embodiments of the invention will now be described, by way of example, with reference to the accompanying drawings, in which.

DETAILED DESCRIPTION

Figure 1:
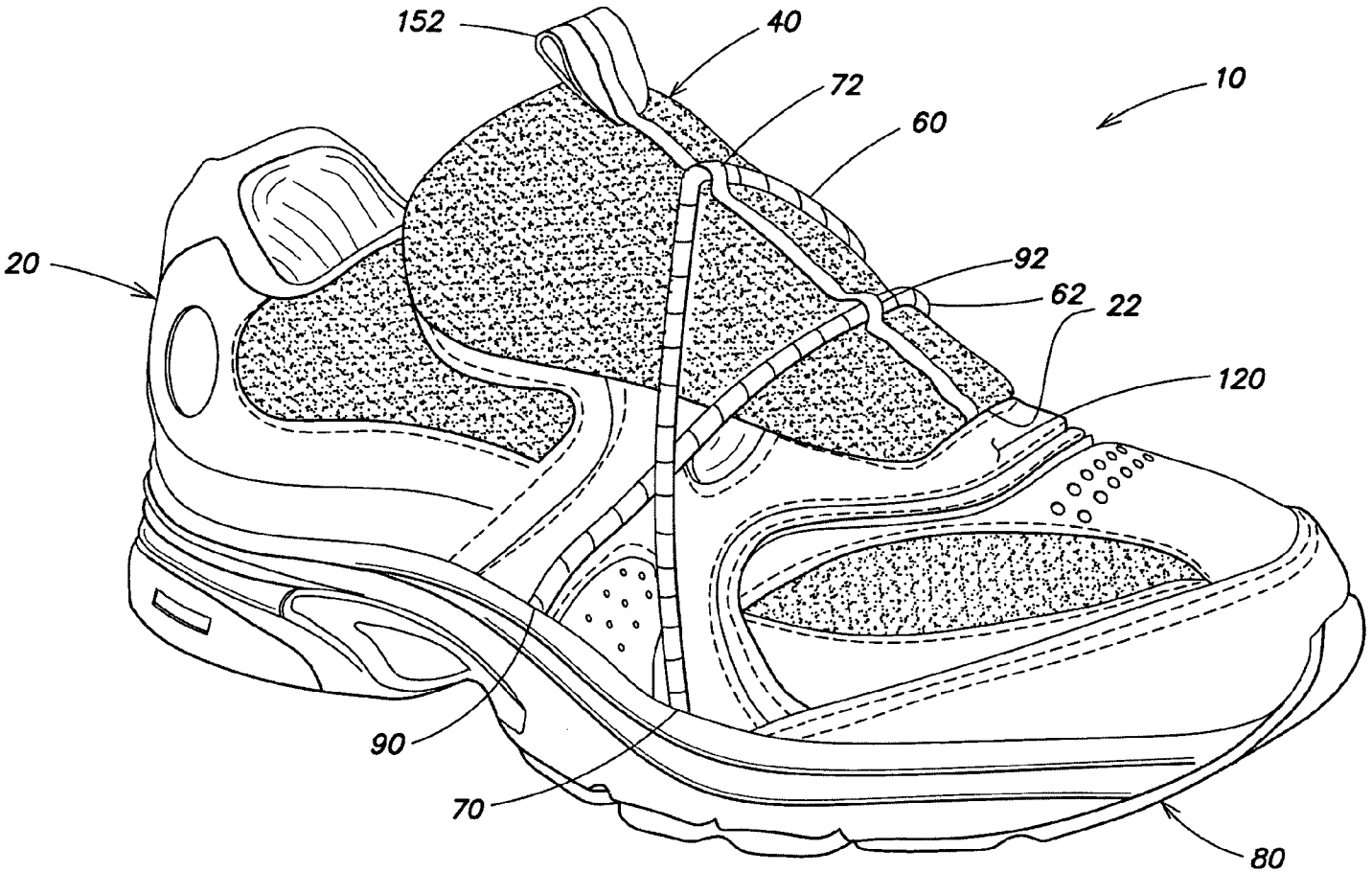
FIG. 1 is a front lateral perspective view of one embodiment of a footwear according to the present invention in a first position.

Aspects of the present invention are directed to footwear having a unique tongue assembly which includes a tongue pivotally coupled to the footwear upper. As discussed above, a conventional footwear tongue typically has laces extending over it such that the position of the tongue with respect to the footwear upper is fixed while the footwear is secured to a foot. In contrast, embodiments of the present invention include a tongue that is movable with respect to the footwear upper while the footwear is secured to the foot.

Certain aspects of the present invention are directed to footwear having a spring-loaded tongue coupled to the footwear upper. When the footwear is secured to the foot, the wearer may pivotally move the tongue and the tongue may be spring-loaded such that the tongue is urged into one or more positions.

The present invention provides a new type of footwear where the wearer may customize the look and position of the footwear tongue. In certain embodiments, a tongue is pivotally coupled to the footwear upper such that the tongue is moveable between at least a first position and a second position.

In a first position, the tongue may extend along an instep portion of a footwear upper. In a second position, the tongue may extend along a toe portion of the footwear upper. The tongue may be configured such that a wearer may choose which position to orient the tongue into and the tongue may remain in that orientation until the wearer moves the tongue into a different position. Thus, in one embodiment, the tongue may remain in a position where it extends along an instep portion of the footwear upper. In another embodiment, the tongue may remain in a position where it extends along a toe portion of the footwear upper.

The tongue may be spring-loaded such that the tongue moves when a spring force is released. The tongue may remain in a rest position until the wearer pivotally moves the tongue to release the spring force. In one embodiment, the tongue may accelerate through a pivoting motion circumscribed by the pivotal coupling between the tongue and the upper until the tongue reaches a rest position.

As discussed in greater detail below, a resilient member may be coupled to the tongue to urge the tongue into one or more desired positions. Movement of the resilient member may activate the spring-loaded tongue. In one embodiment, the resilient member extends from a medial side of the footwear to the lateral side of the footwear, crossing over, under, or through the tongue.

Turning now to the drawings, it should be appreciated that the drawings illustrate various components and features which may be incorporated into various embodiments of the present invention. For simplification, several drawings may illustrate more than one optional feature or component. However, the present invention is not limited to the specific embodiments disclosed in the drawings. It should be recognized that the present invention encompasses embodiments which may include only a portion of the components illustrated in any one figure, and/or may also encompass embodiments combining components illustrated in multiple different drawings, and/or may also encompass embodiments not explicitly disclosed in the drawings.

Figure 2:
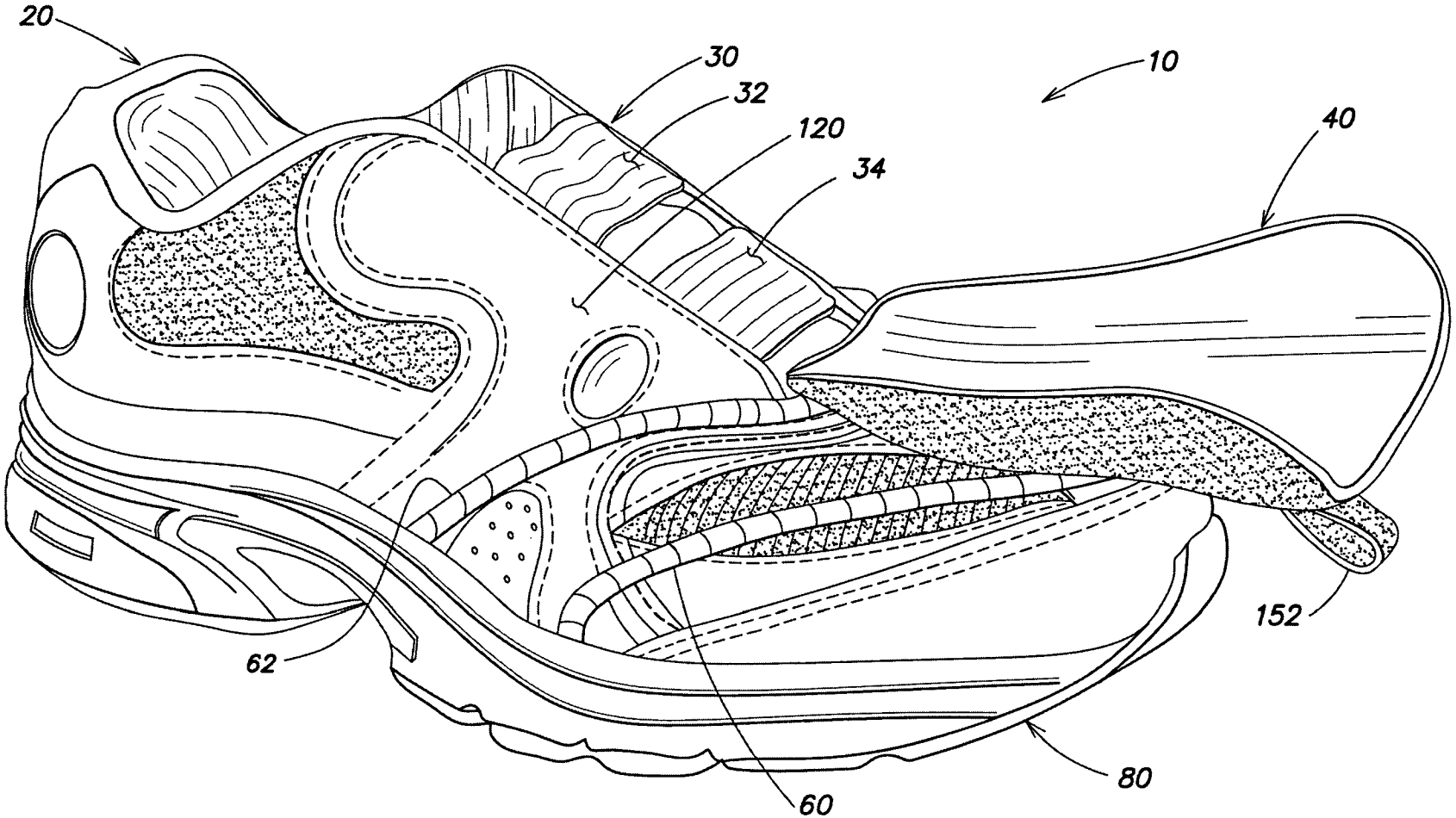
FIG. 2 is a front lateral perspective view of the footwear embodiment illustrated in FIG. 1 shown in a second position.

In FIGS. 1-2, a perspective view of one embodiment of a footwear 10 according to the present invention is illustrated. In this particular embodiment, the footwear 10 includes an upper 20 arranged to support a top portion of a foot and a sole 80 coupled to the upper 20 and arranged to support a bottom portion of the foot. A tongue 40 is pivotally coupled to the upper 20 at hinge 22 and the tongue 40 is arranged to pivotally move relative to the upper between at least a first position and a second position. As shown in the illustrative embodiment, the tongue 40 may be constructed to pivot radially along an arc circumscribed by the hinge 22. In one embodiment illustrated in FIG. 1, in a first position, the tongue extend substantially along an instep portion of the upper 20. In one embodiment illustrated in FIG. 2, in a second position, the tongue extends substantially along a toe portion of the upper 20. A wearer may move the tongue 40 into at least either the first and/or second position based upon their personal preference and the position of the tongue 40 may be altered while the footwear 10 is worn on the wearer's foot. It should be appreciated that in other embodiments the first and second positions of the tongue 40 may be configured in different locations with respect to the upper 20. For example, in some embodiments, in a first and/or second position, the tongue 40 may extend towards the medial and/or lateral side of the footwear upper 20 as the invention is not limited in this respect.

As shown in FIGS. 1-2, in one embodiment, at least one resilient member 60 is coupled to the tongue 40 for urging the tongue 40 in at least either the first position or the second position. In one embodiment, the at least one resilient member 60 may be configured to accelerate the tongue 40 in the direction of either the first position or the second position. In the particular embodiment illustrated in FIGS. 1-2, both a first resilient member 60 and a second resilient member 62 is provided. In other embodiments, only one resilient member may be provided, and in yet other embodiments two, three, four or more resilient members may be provided as the invention is not limited in this respect.

Figure 3:
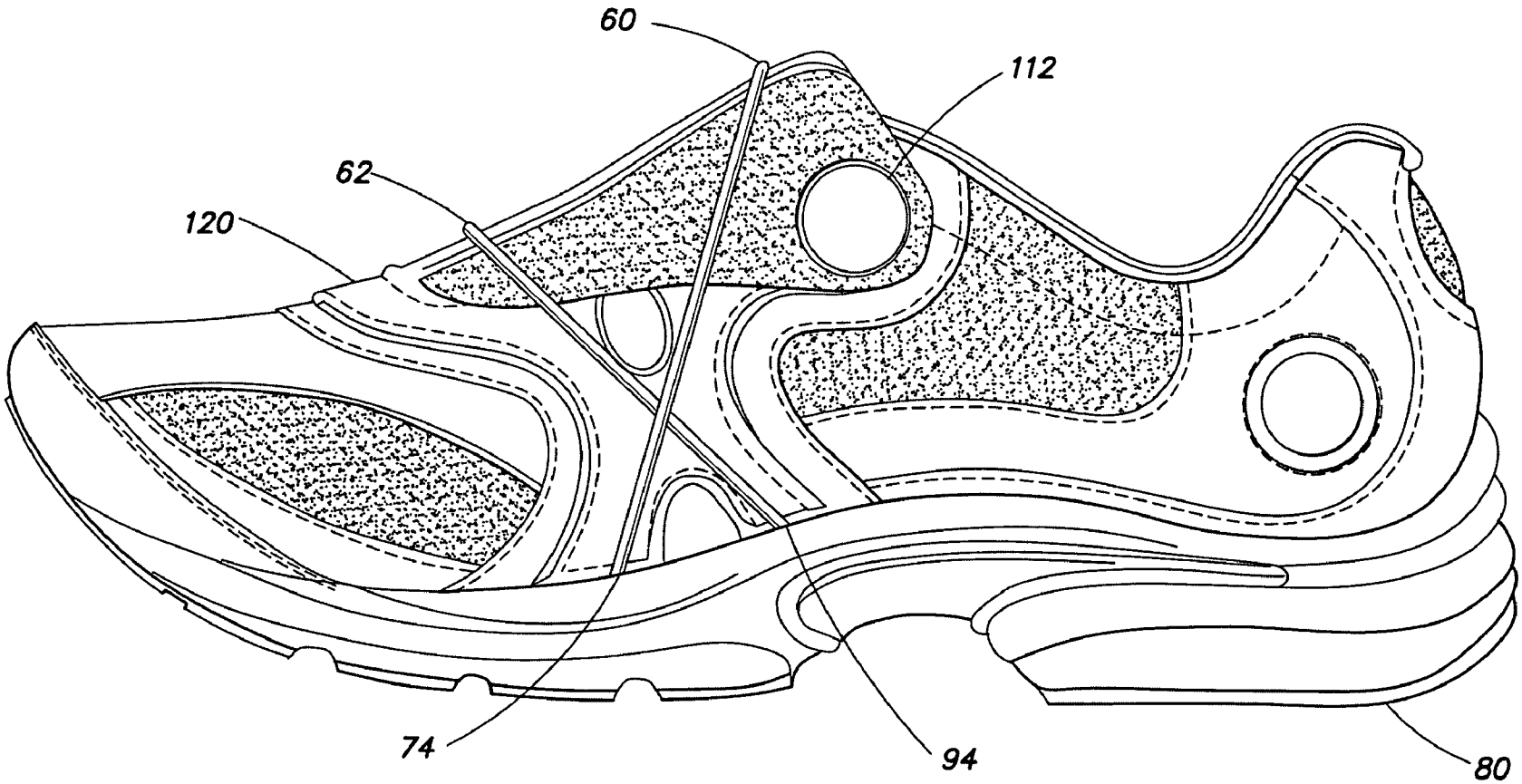
FIG. 3 is a medial side view of one embodiment of a footwear according to the present invention.

In one embodiment, the first resilient member 60 is fixed at a first location 74 on the medial side of the footwear 10 (see medial side view shown in FIG. 3), at a second location 72 on the tongue 40, and at a third location 70 on the lateral side of the footwear 10 (see lateral view shown in FIG. 1). In embodiments having a second resilient member 62, the second resilient member 62 may also be fixed at a first location 94 on the medial side of the footwear 10 (see medial side view shown in FIG. 3), at a second location 92 on the tongue 40, and at a third location 90 on the lateral side of the footwear 10 (see lateral view shown in FIG. 1). As shown in FIGS. 1-3, in one embodiment, the location 70, 74 where the first resilient member 60 is fixed on the medial and/or lateral side may be offset from the location 90, 94 where the second resilient member 62 is fixed on the same side. Similarly, in one embodiment, the location 72 where the first resilient member 60 is fixed on the tongue 40 may also be offset from the location 92 where the second resilient member 62 is fixed to the tongue 40. In other embodiments, the location where the first resilient member 60 is fixed to either the tongue, upper, and/or sole 80 may be substantially in the same position as the location where the second resilient member 62 is also fixed to the tongue 40, upper 20 and/or sole 80.

Aspects of the present invention are directed to embodiments where the orientation of one resilient member 60 with respect to another resilient member 62 changes as the tongue 40 pivots between the first position and the second position. For example, as shown in FIG. 1, in one embodiment, when the tongue 40 is in the first position, the first resilient member 60 crosses over the second resilient member 62. As the tongue 40 pivots from the first position to the second position (FIG. 2), the first and second resilient members 60, 62 may uncross. In particular, as shown in FIG. 2, in one embodiment, the first resilient member 60 is substantially parallel to the second resilient member 62 when the tongue 40 is in the second position. In other embodiments when the tongue 40 is pivoted to the second position, the first and second resilient members 60, 62 may be uncrossed but may not be substantially parallel as the invention is not so limited. It should be appreciated that in other embodiments, the first resilient member 60 may cross under the second resilient member 62.

As shown in FIG. 2, when the tongue 40 is positioned in an open position such that the tongue 40 pivots towards the toe portion of the footwear 10, a closure system 30 for securing a foot within the upper 20 may be exposed. In this particular embodiment, the closure system is an elastic webbing coupled to the instep portion of the upper 20, and may for example include a GORE™ elastic material manufactured by W.L. Gore and Associates, Inc. from Newark, Del. The closure system 30 may extend along a majority of the length of the instep portion and as shown in FIG. 2, the closure system 30 may include a plurality of spaced apart connecting segments 32, 34. In other embodiments, the closure system 30 may include laces or hook and loop fasteners. In certain embodiments, the tongue 40 may substantially cover the closure system 30. For example, as shown in FIG. 1, when the tongue 40 is in the first position along the instep portion of the upper 20, the closure system 30 is not visible.

It should be recognized that although a closure system 30 may be provided for assisting to secure a foot within the upper 20, the presence of a closure system 30 may not affect the ability of the tongue 40 to pivot relative to the upper 20. In other words, unlike a conventional closure system, such as laces, in one embodiment, the closure system 30 of the present invention does not keep the tongue 40 in a substantially stationary position when the footwear is worn on a foot.

In one illustrative embodiment, the footwear 10 may also include an attachment system for releasably coupling a portion of the tongue 40 to a portion of the upper 20 when the tongue 40 is in selected positions. As mentioned above, the tongue 40 is pivotally coupled to the upper 20 at hinge 22. In one embodiment, an attachment system is provided such that in selected positions the tongue 40 and the upper 20 are coupled at another location spaced apart from the hinge 22. In one embodiment, the attachment system includes a first attachment component 110 coupled to the upper (see FIG. 4 where the tongue 40 is shown removed) and a second attachment component 112 coupled to the tongue 40 (see FIG. 3). The second attachment system 112 may be coupled to the underside of the tongue 40 such that the two components contact each other when the tongue 40 is in the first position.

Figure 4:
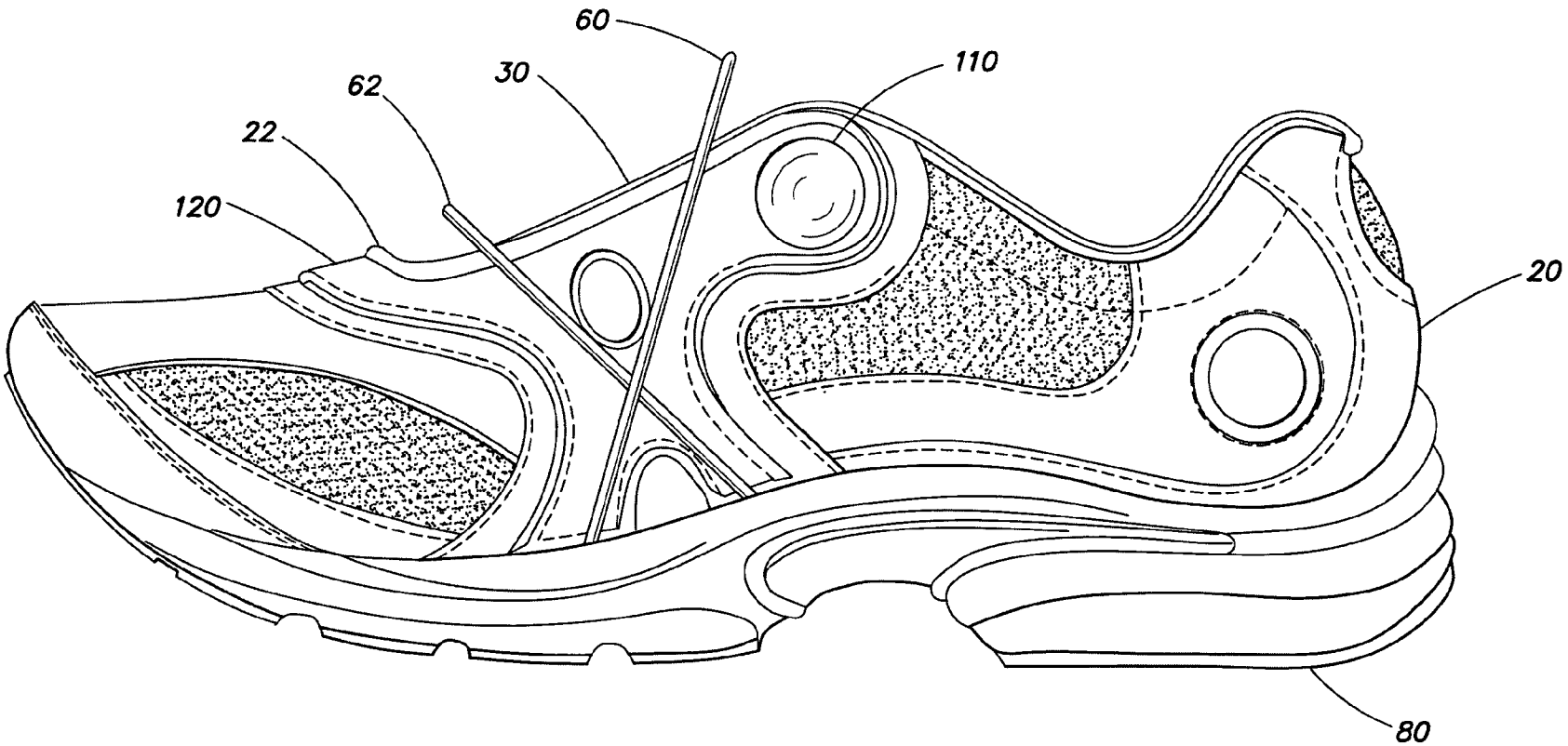
FIG. 4 is a medial side view of the footwear embodiment illustrated in FIG. 3 with the tongue removed.

In one embodiment, the first and second attachment components 110, 112 are mating magnetic fasteners that are attracted to each other such that the components are releasably coupled to each other upon contact. In some embodiments, the attachment system may include first and second components positioned on both the medial and lateral sides of the footwear 10. As shown in FIG. 4, one of the attachment components, such as the first attachment component 110 may be recessed to accept a mating portion of the other attachment component 112. It is also contemplated that the first and second attachment components 110, 112 may include at least one of a snap fastener, clip fastener, and hook and loop fastener, as the invention is not limited to magnetic fasteners.

It should be appreciated that in embodiments including an attachment system, one or more resilient members 60, 62 may be coupled to the tongue 40 for urging the tongue 40 into a certain position. In these embodiments, the attachment system may be provided to supplement the resilient members 60, 62, as the resilient members 60, 62 may be, on their own, holding the tongue 40 in a certain position. In this respect, the addition of an attachment system may be used to prevent an outside force from accidentally pivoting the tongue 40.

The upper 20 may extend from the toe/forefoot portion of the footwear 10, through the instep/midfoot portion and wrapping around the heel portion in the rear.

Figure 5:
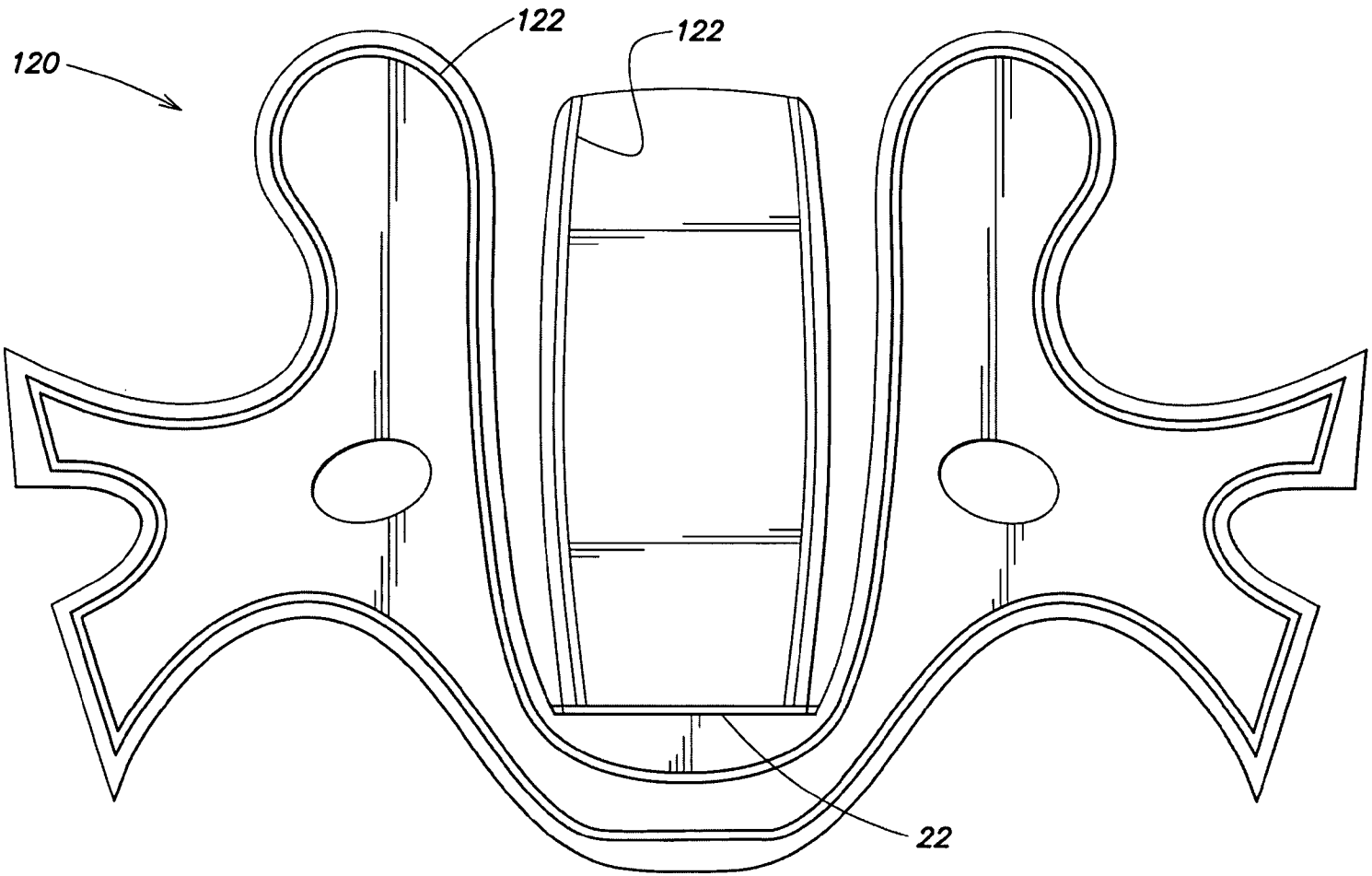
FIG. 5 is a top view of a brace for extending around the footwear according to one embodiment of the present invention.

As shown in FIGS. 1-4, in one embodiment, a brace 120 may extend over the upper 20 to provide additional support to a foot. In one embodiment, the brace 120 may extend from the medial side of the footwear across the instep portion and over to the lateral side of the footwear. As shown in FIGS. 1-4, the brace 120 may extend down to the outsole 80 on each side of the footwear 10. In one embodiment, portions of the brace 120 may extend under the path of one or more of the resilient members 60, 62. FIG. 5 illustrates a brace 120 according to one embodiment before the brace is attached to a footwear upper 20. As shown, the brace may be substantially symmetrical about a line extending down along the instep portion of the brace 120. In one embodiment, the brace 120 is sewn to the upper 20 and the brace 120 may include a stitching groove 122 inwardly spaced about its periphery which may define a stitching pattern to attach the brace 120 to the upper 20.

As shown in the embodiment illustrated in FIGS. 1-2, the tongue 40 is pivotally coupled to the upper along a hinge 22 or pivot point and the pivot point is positioned proximate at least one of the instep portion of the upper 20 and the toe portion of the upper 20. As shown in the embodiment shown in FIG. 5, the brace 120 may help to define the location of the hinge 22. In one embodiment, the hinge 22 may be a living hinge or flex point formed from a thinner section of the brace 120. In the illustrated embodiment, the hinge 22 or pivot point is positioned between the instep portion of the footwear 10 and the toe portion of the footwear 10. In other embodiments, the hinge 22 or pivot point may be positioned farther towards the front of the footwear such that the hinge 22 is within the toe portion of the footwear 10. In yet other embodiments, the hinge 22 or pivot point may be positioned farther towards the rear of the footwear 10 such that the hinge is within the instep portion of the footwear 10.

Figure 6:
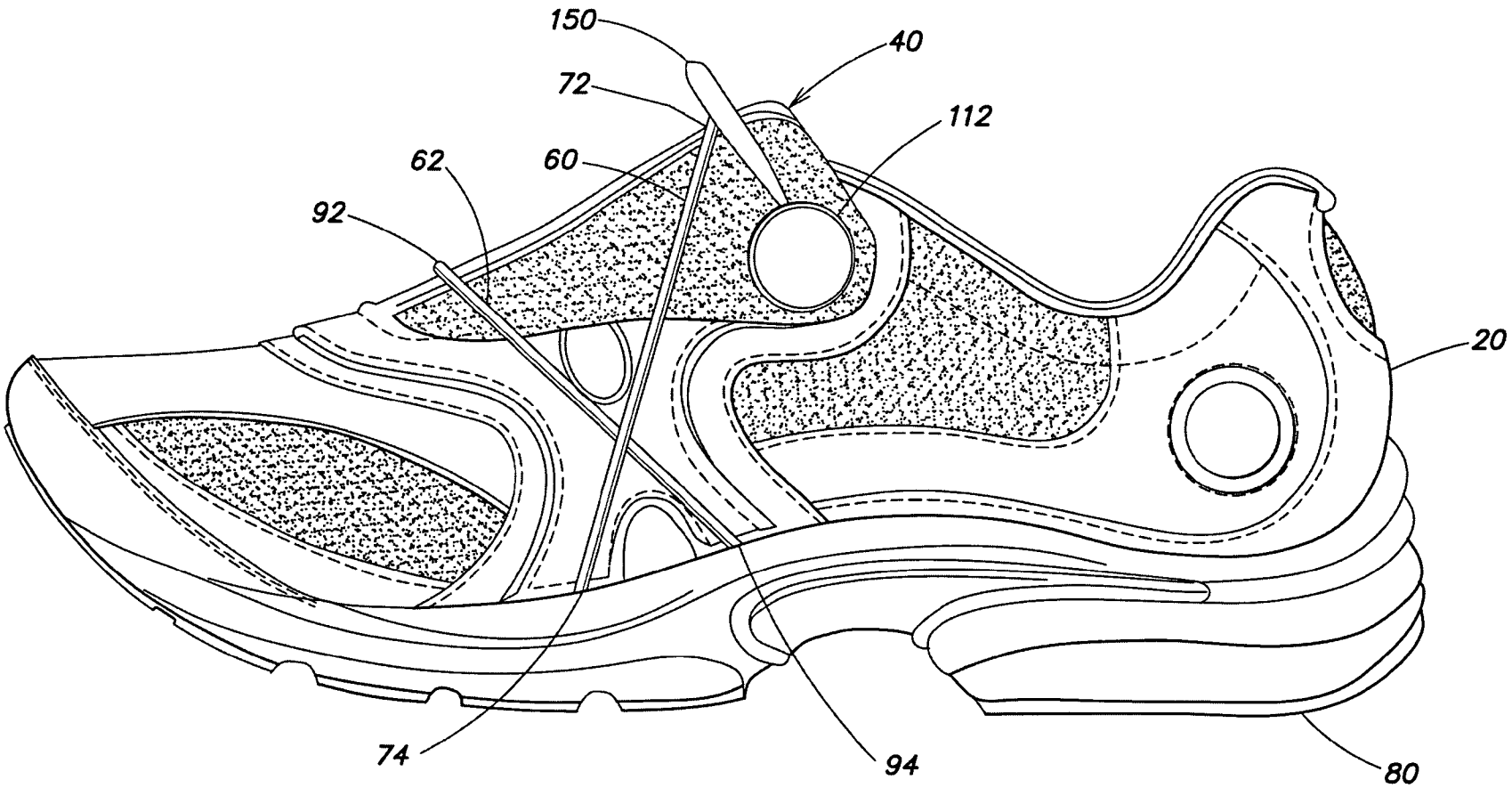
FIG. 6 is a medial side view of another embodiment of footwear according to the present invention.
Figure 7:
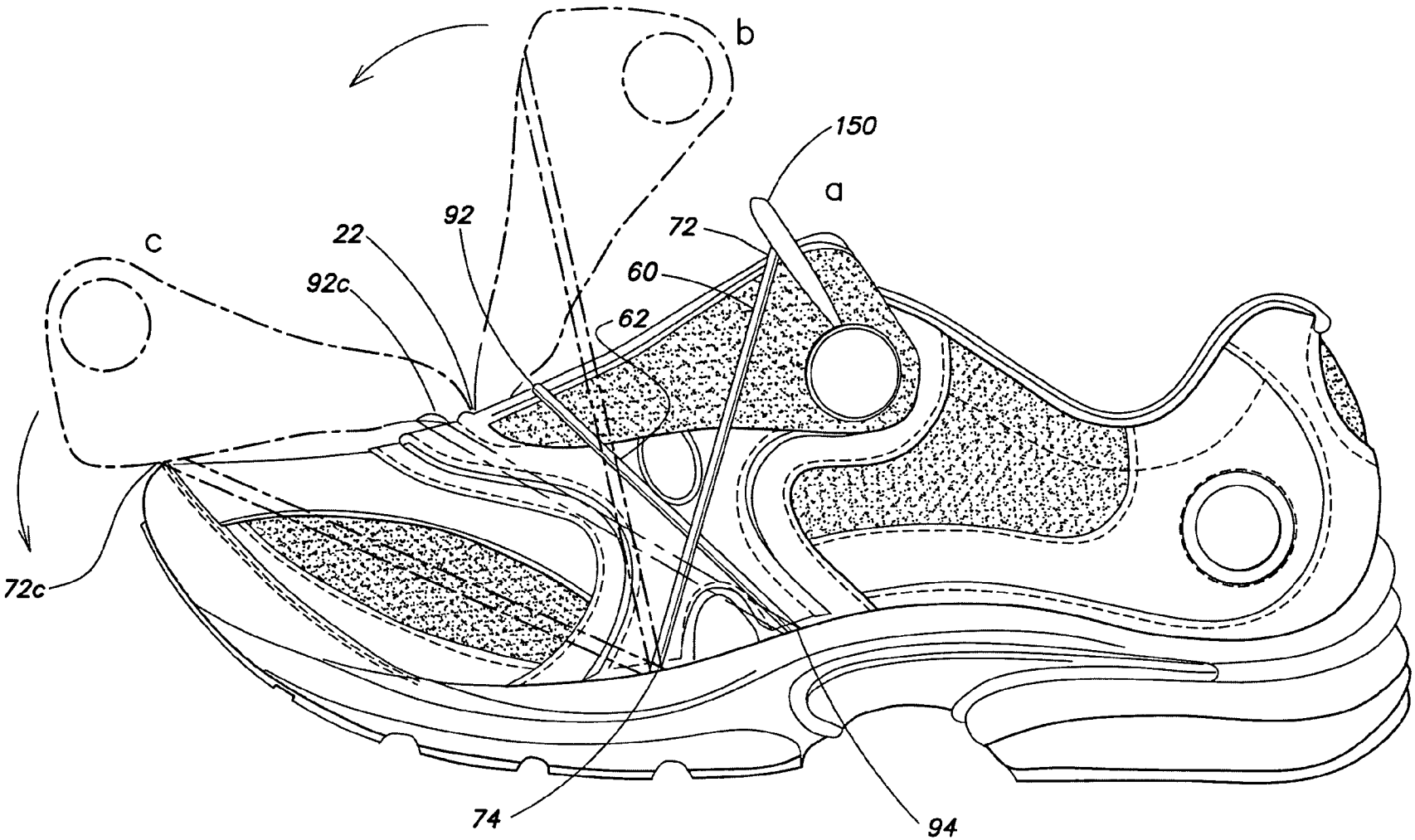
FIG. 7 is a medial side view of the footwear embodiment illustrated in FIG. 6 shown with a tongue pivoting between a first position and a second position.

Turning now to FIGS. 6-7 footwear embodiments having a spring-loaded tongue 40 will now be described in further detail. In this particular embodiment, movement of at least one resilient member activates the spring-loaded tongue. As discussed in greater detail below, in another embodiment, other spring mechanisms may be used to activate a spring-loaded tongue.

The footwear 10 shown in FIG. 6 is similar to the footwear shown in FIG. 3. In addition, the footwear 10 shown in FIG. 6 also includes a pull loop 150 coupled to the tongue 40. A wearer may use the pull tab 150 to grasp the tongue 40 to change the position of the tongue 40 between, for example, the first position and the second position. In one particular embodiment, the pull loop 150 may extend from an attachment component 112 located on one side of the tongue 40 to an attachment component (not shown) on the opposite side of the tongue 40. In embodiments where a pull tab 150 is coupled to the tongue 40 adjacent an attachment component 112, the pull tab 150 may also assist in detaching a first attachment component 110 from the second attachment component 112 to separate the tongue 40 from the upper 20. In other embodiments, such as the embodiment shown in FIGS. 1-2, a pull tab 152 may be provided along the centerline of the tongue 40.

In this illustrative embodiment, tongue 40 is spring-loaded and is pivotally coupled to the upper 20 between a first position (labeled "a" in FIG. 7) and a second position (labeled "c" in FIG. 7) such that when the tongue 40 is positioned in an intermediate position (labeled "b" in FIG. 7) between the first position and the second position, the tongue 40 will move or spring towards either the first position or the second position.

In one embodiment, when the tongue 40 is positioned in an intermediate position, the determination of whether the tongue 40 will move towards the first position or the second position may depend upon the location of the intermediate position. For example, if in the intermediate position, the tongue 40 is closer to the first position (labeled "a") in comparison to the second position (labeled "c"), the spring-loaded tongue 40 may spring towards the first position. In another embodiment, if in the intermediate position, the tongue is closer to the second position, the spring-loaded tongue 40 may spring towards the second position.

Furthermore, in embodiments having at least one resilient member 60, 62 causing the tongue 40 to be spring-loaded, the determination of which position the tongue 40 will spring toward may depend upon the orientation and strength of the resilient member 60, 62.

In the embodiment illustrated in FIGS. 6-7, at least one resilient member 60 extends from a first fixed location 74 on a medial side of the footwear 10 to a second fixed location 72 on the tongue 40 and to a third fixed location 70 (see FIG. 1) on a lateral side of the footwear 10. As shown in FIG. 7, as the tongue 40 pivotally moves from the first position (labeled "a") to the second position (labeled "c"), the at least one resilient member 60 pivotally moves over the axis of rotation, which may be defined as the hinge 22. As indicated in FIG. 7, once the tongue 40 is in the second position, the location where the resilient member 60 is fixed to the tongue 40 rotates to 72*c*, which in this particular embodiment is in the toe portion of the footwear 10.

Similarly, in this illustrative embodiment, the second resilient member 62 extends from a first location 94 on a medial side of the footwear 10 to a second fixed location 92 on the tongue and to a third fixed location 90 (see FIG. 1) on a lateral side of the footwear 10. As the tongue 40 pivotally moves from the first position (labeled "a") to the second position (labeled "c"), the second resilient member 62 pivotally moves over the axis of rotation, which may be defined as the hinge 22. As indicated in FIG. 7, once the tongue 40 is in the second position, the location where the second resilient member 62 is fixed to the tongue 40 rotates to 92*c*, which in this particular embodiment is adjacent the hinge 22.

The orientation of the one or more resilient members 60, 62 may vary as the invention is not limited in this respect. As shown in FIG. 6, in one embodiment, the resilient member 60 is positioned such that its first fixed location 74 on the medial side and the third fixed location 70 (see FIG. 1) on the lateral side are both positioned forward of the second fixed location 72 on the tongue 40 when the tongue 40 is in the first position (labeled "a"). In this embodiment, as shown in FIG. 7, when the tongue 40 is pivotally moved to its second position (labeled "c"), the first fixed location 74 and the third fixed location 70 of the resilient member 60 are both positioned rearward of the second fixed location 72*c* on the tongue 40. In this embodiment, the first fixed location 74 on the medial side and the third fixed location 70 on the lateral side are both positioned rearward of the hinge 22 regardless of the orientation of the tongue.

As shown in FIG. 6, in one embodiment, the second resilient member 62 is positioned such that its first fixed position 94 on the medial side and the third fixed position 90 (see FIG. 1) on the lateral side are both positioned rearward of the second fixed position 92 on the tongue 40 when the tongue 40 is in the first position (labeled "a"). In this embodiment, as shown in FIG. 7, when the tongue 40 is pivotally moved to its second position (labeled "c"), the first fixed location 94 and the third fixed location 90 of the resilient member 62 both remain in a position rearward of the second fixed position 92. In this embodiment, the first fixed location 94 on the medial side and the third fixed location 90 on the lateral side are both positioned rearward of the hinge 22 regardless of the orientation of the tongue.

Although the materials of the above-described components may vary, in some embodiments, the tongue 40 include a substantially rigid or stiff material such that the tongue remains substantially planar as shown in FIG. 7 as it moves between the first position (labeled "a") and the second position (labeled "c"). It is contemplated that the tongue 40 may include, but is not limited to, materials of construction such as plastic, textile, or metal. In one embodiment, portions or all of the tongue 40 may be formed of thermoplastic polyurethane (TPU).

In footwear embodiments which include a brace 120, the brace 120 may also include a substantially rigid or stiff material to provide additional support. In one embodiment the brace 120 is constructed of a material which helps to stiffen the upper 20 to offset the tension with the resilient members 60, 62. It is contemplated that in one embodiment, the brace 120 includes a plastic material, and may for example be formed of thermoplastic polyurethane (TPU).

It should also be appreciated that the one or more resilient members 60, 62 may also be made from a variety of materials, as the invention is not so limited. For example, in one embodiment, a resilient member 60 may be made from an elastic material and may be formed from a elastic cord of material (such as a shock cord or a bungee cord). In other embodiments, the resilient member 60 may be made from a elastic tubing, and in yet other embodiments, the resilient member 60 may be formed from other materials, such as, but not limited to, a stretchable metal or plastic. For example, a metal or plastic material may be formed into a helical spring shape to form a resilient member 60. It is also contemplated that in some embodiments, one or more resilient members 60 may pass through a sleeve which may act as a protective tubing.

Furthermore, it should be appreciated that in embodiments having more than one resilient member 60, 62, the type of material used to form one resilient member 60 may vary from the type of material used to form a second resilient member 62. However, in one embodiment, multiple resilient members 60, 62 on the footwear 10 may be formed from the same material.

It should also be appreciated that the type of material used to form a resilient member 60 and the configuration of the resilient member 60 may alter the characteristics of the pivoting tongue 40. In general, the greater the spring constant of resilient member 60, the more energy the resilient member 60 may be able to store in a spring-loaded position. Also, a longer resilient member 60 may allow the tension throughout the length of the resilient member to be more spread out in comparison to a shorter resilient member 60.

It is also contemplated that the positioning and/or length of a resilient member may be adjustable by a wearer. For example, in one embodiment, an adjustment mechanism, such as a ratchet assembly may be provided such that a wearer can increase or decrease the effective length of a resilient member to vary the amount of tension along the resilient member. In another embodiment, the positioning of the resilient member may be adjusted, with a slidable track positioned along a portion of the footwear 10 such that one or more of the fixed locations 70, 72, 74, 90, 92, 94 is adjustable. In this respect, the amount of tension in the resilient member may be controlled by the wearer. In one embodiment, moving the second fixed location 72 of the resilient member 60 farther up along the tongue 40 may act to stretch out and thus tighten the resilient member 60. In another embodiment, moving the first or third fixed location 70, 74 of the resilient member 60 farther towards the front of the footwear may also act to stretch out and thus tighten the resilient member 60.

Adjustments in the positioning and/or length of a resilient member may also be made to alter the position of the tongue in a rest position. In one embodiment, the position of the tongue 40 in the first position and/or second position may be altered by adjusting the position of the resilient member with the adjustment mechanism to balance out the elastic forces. By moving a resilient member, the tongue 40 may have a rest or stationary position in a different location along the pivotal path of the tongue. As discussed in more detail below, in other embodiment, other types of spring mechanisms may be used and different types of adjustment mechanisms may be provided to alter the rest or stationary position(s) of the tongue 40.

Figure 8:
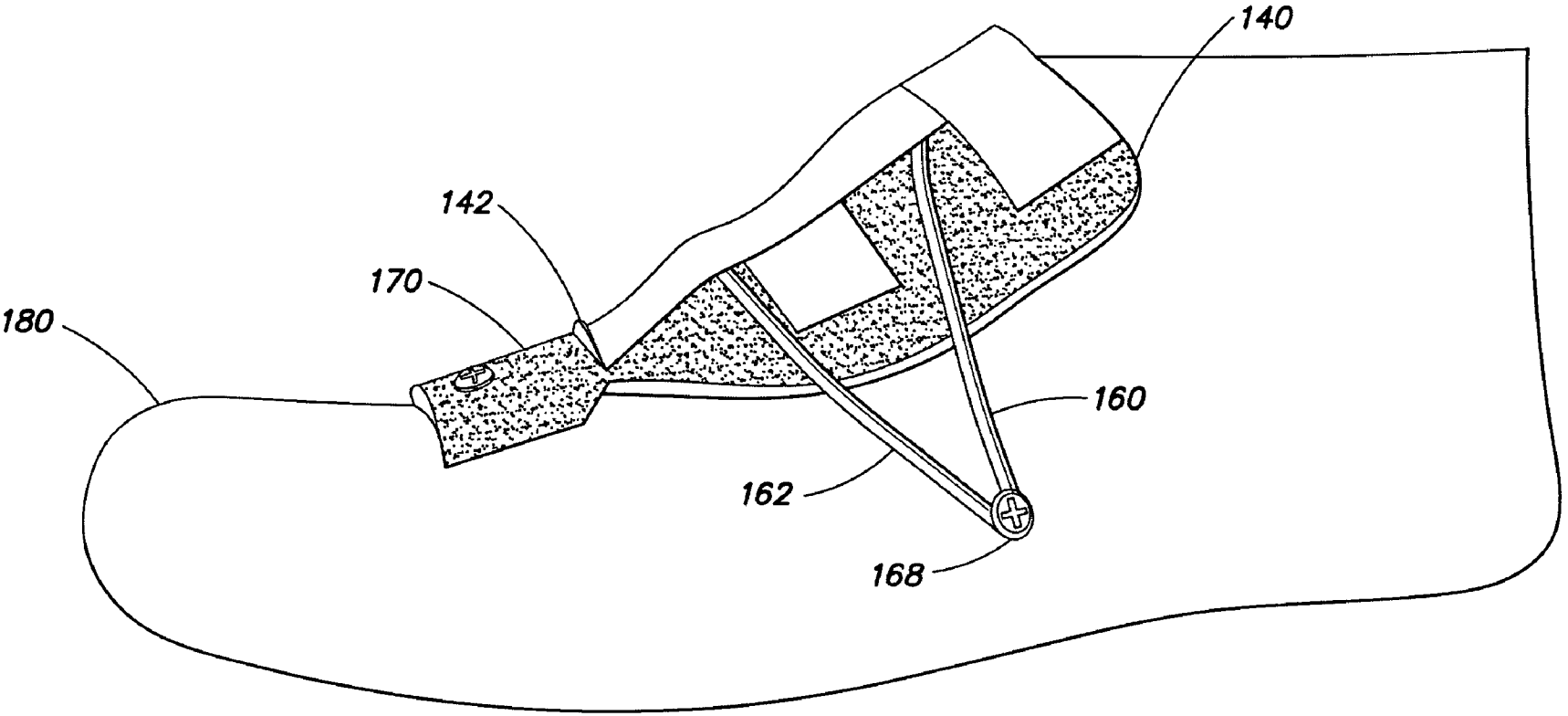
FIG. 8 is a lateral side perspective view of a tongue positioned on a last in a first position.
Figure 9:
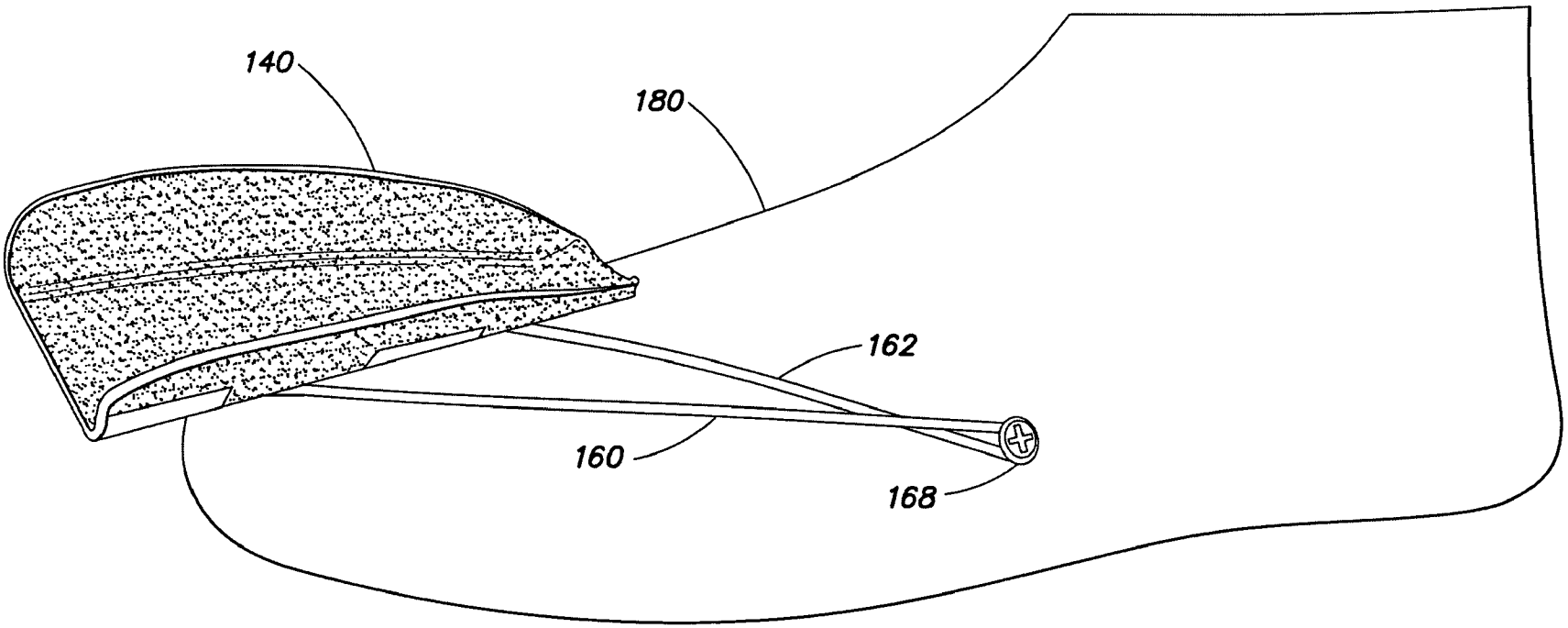
FIG. 9 is a lateral side perspective view of the tongue illustrated in FIG. 9 with the tongue positioned on the last in a second position.

Turning to FIGS. 8-9, another embodiment of a tongue 140 is illustrated. For convenience, in these figures, the tongue 140 is shown positioned on a footwear last 180 which may be used to form a footwear upper 20. It should be appreciated that in use, the tongue 140 would be coupled to the upper 20 and/or the sole 80 as discussed above, and is also pivotable with respect to the upper 20 about a hinge 142 between at least a first position and a second position. In one illustrative embodiment, FIG. 8 illustrates a first position of the tongue 140, and FIG. 9 illustrates a second position of the tongue 140.

In this illustrative embodiment, a stiffening component 170 is positioned adjacent the hinge 142 in the toe portion of the footwear. In one embodiment, the stiffening component 170 is formed as an extension of the tongue 140 separated by the hinge 142 In another embodiment, the stiffening component 170 may be detached from the tongue 140. The stiffening component 170 may be constructed to offset or balance the tongue 140 about the pivot point when the tongue 140 is in the second position so that the tongue 140 is more stable in the second position than without the stiffening component 170. It should be recognized that in other embodiments, the stiffening component 170 may be formed into portions of the upper 20. Furthermore, it should also be recognized that in some embodiments, the tongue may be unstable in the second position when the footwear is empty, but when a foot is within the footwear 10, the foot itself may act like the stiffening component 170 such that the tongue is stable in the second position when the foot in within the footwear.

In one embodiment, the first and second resilient members 160, 162 may be formed of one continuous member. As shown in FIGS. 8-9, in one embodiment, the resilient members 160, 162 are formed of an elastic band of material which may be fixed at a location 168 on each side of the footwear. The elastic band of material may wrap around the fixed location 168 to form both the first and second resilient members 160, 162. It should be appreciated that in other embodiments, the first resilient member 160 may be formed as a separate component from the second resilient member 162.

As shown in FIGS. 8-9, in one embodiment, the first and second resilient members 160, 162 do not cross each other in the first position (FIG. 8), whereas in the second position (FIG. 9, the two resilient members 160, 162 cross on each side of the footwear.

Figure 10A:
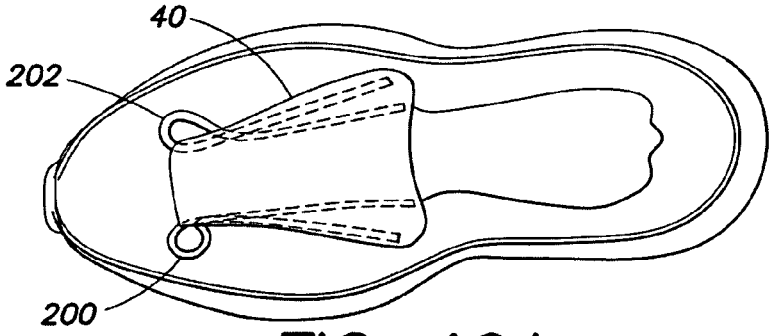
FIGS. 10A-10B are top and side views of another embodiment of a footwear according to the present invention.
Figure 10B:
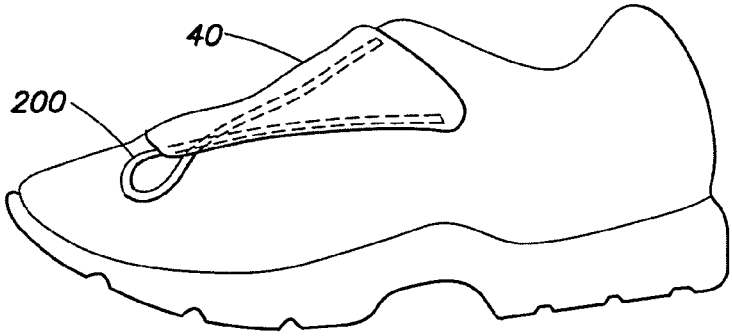
Figure 11A:
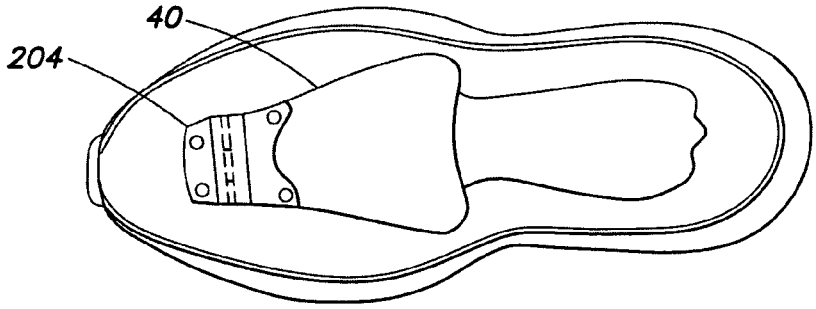
FIGS. 11A-11B are top and side views of another embodiment of a footwear according to the present invention.
Figure 11B:
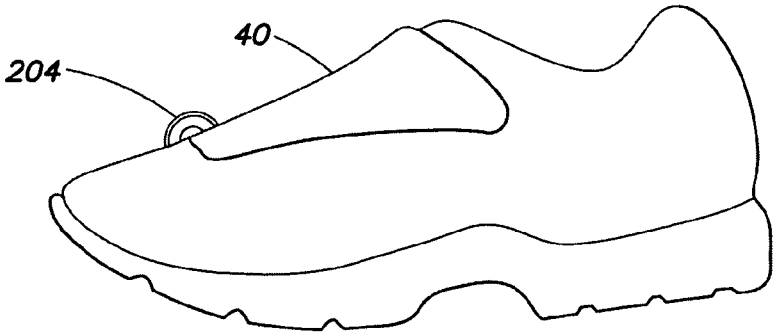
Figure 12A:
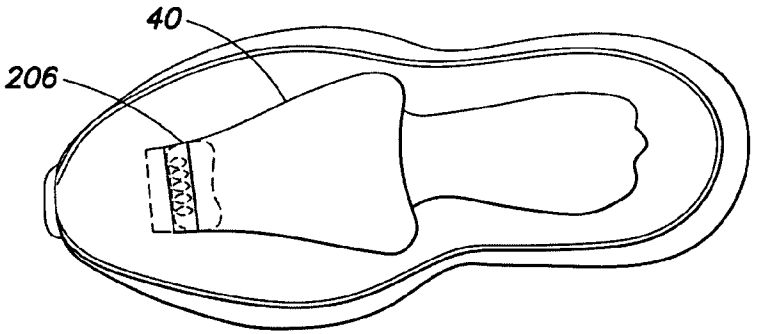
FIGS. 12A-12B are top and side views of yet another embodiment of a footwear according to the present invention.
Figure 12B:
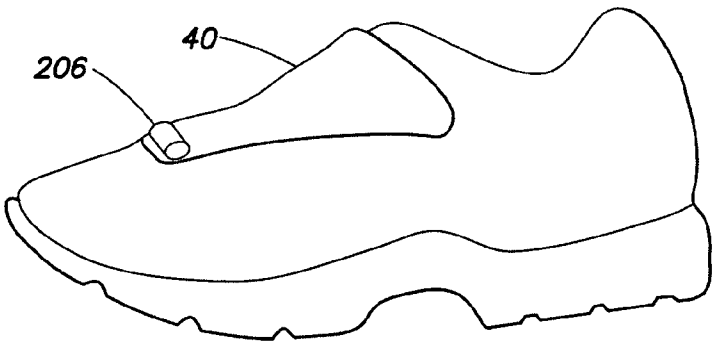

It should be appreciated that although the illustrative embodiments include a spring-loaded tongue 40 with one or more resilient members in the form of resilient bands, the invention is not limited in this respect. As shown in FIGS. 10A-13B, the present invention also contemplates other embodiments for a spring-loaded tongue 40. For example, as shown in FIGS. 10A-10B, in one embodiment, in addition to, or instead of a resilient band, the tongue 40 may be spring-loaded with another spring mechanism or resilient member, such as a wire spring 200, 202. In this particular embodiment, a wire spring 200, 202 is positioned on each side of the tongue 40 to create a spring-loaded tongue 40 which is moveable between at least a first position and a second position. In the embodiment illustrated in FIGS. 11A-11B, another type of spring mechanism or resilient member, such as a leaf spring 204 may be provided to create a spring-loaded tongue 40. This leaf spring 204 may be similar to a conventional jewelry box hinge closure and may be bias the tongue 40 in one or more positions about its pivot hinge. In yet another embodiment, as shown in FIGS. 12A-12B, another type of spring mechanism or resilient member such as a coil spring hinge 206 may be provided to create a spring-loaded tongue 40.

Figure 13A:
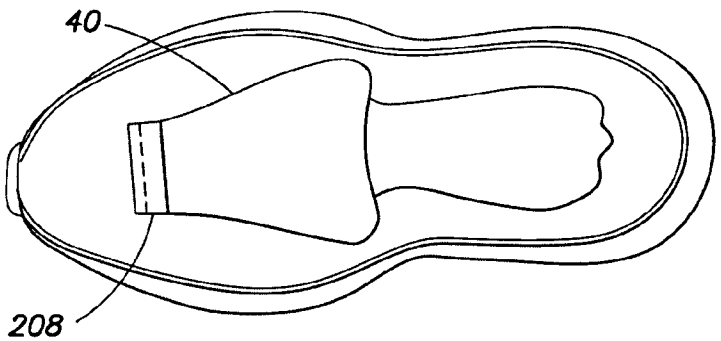
FIGS. 13A-13B are top and side views of another embodiment of a footwear according to the present invention.
Figure 13B:
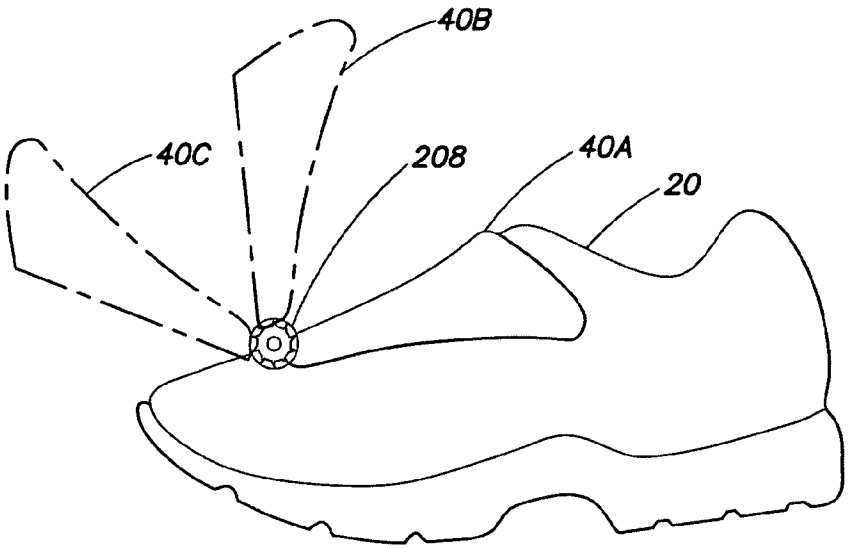

As shown in FIGS. 13A-13B, in one embodiment, the tongue 40 may include an adjustment mechanism, such as a ratchet mechanism 208 which may be adjusted to move the tongue 40 in the desired position with respect the upper 20. The adjustment mechanism may alter the angular orientation of the tongue 40 with respect the upper 20 when the tongue is in either the first position or the second position. In one embodiment, the ratchet mechanism 208 may be oriented to position the tongue to remain in the orientation 40A. In another embodiment, the ratchet mechanism may be oriented to position the tongue to remain in the orientation 40B, and in another embodiment, the ratchet mechanism may be oriented to position the tongue to remain in the orientation 40C. It should be appreciated that in one embodiment, the ratchet mechanism 208 may be provided to position the tongue in any desirable position with respect to the footwear upper 20. It should also be appreciated that other types of adjustment mechanisms may also be provided to adjust the position of the tongue 40 as the invention is not limited to ratchet mechanisms.

The spring mechanism may be substantially on the outer portion of the footwear 10 (as shown in the figures with resilient member 60). In another embodiment, the spring mechanism may be substantially on the inner portion of the footwear 10 such that all or portions of the mechanism are not generally visible when the footwear 10 is worn on a foot. For example, in one embodiment, portions of the spring mechanism, such as a resilient member 60, may extend underneath the tongue 40. In this embodiment, the resilient member 60 may be fixed to the underside of the tongue 40. In another embodiment, the spring mechanism may be inside of the footwear 10, as the invention is not so limited.

It is also contemplated to provide additional accessories to the footwear 10 which may allow a wearer to further customize the footwear. For example, in one embodiment, the footwear 10 may be provided with a control system so that the user may selectively activate a light and/or a noise. In one embodiment, the footwear may be constructed such that a light and/or noise may automatically activate when the tongue 40 pivots into a particular position. For example, in one embodiment, a light and/or noise may be activated when the tongue pivots into the second position (labeled "c" in FIG. 7). In one embodiment, the light and/or noise may be in a deactivated state when the tongue 40 is in another position, such as for example, when the tongue pivots into the first position (labeled "a"). The light may be coupled to a portion of the upper 20 and may incorporate LED's. In one embodiment, the control system may communicate with an electrical switch coupled to the hinge 22 and/or the tongue 40 to determine the position of the tongue 40.

The footwear 10 may include one or more portions of the tongue 40 which may be customizable. For example, the underside of the tongue 40 may include decorative features which may be exposed when the tongue 40 is in an open position, such as when the tongue 40 is in the second position. In one embodiment, the decorative features may be incorporated into the footwear 10 during a manufacturing step. In another embodiment, decorative features may be added to the tongue 40 by the wearer. The tongue 40 may be configured such that a card is securable to the underside of the tongue 40. The card may include a decorative feature, and in one embodiment, a plurality of interchangeable cards may be provided with the footwear 10 such that the wearer may select the desired decorative feature. In yet other embodiments, other information, such as medical information, medicines, allergies, contact information, etc. may be stored on a card on the underside of the tongue 40 which may be used in the event of an emergency.

The materials of construction for the upper 20 and sole 80 may also vary as the invention is not limited in this respect. For example, in one embodiment, materials such as fabrics, leathers, plastics, and/or metals may be used to form the upper 20, and materials such as rubber, plastics, leathers and/or textiles may be used to form the sole 80.

It should be appreciated that various embodiments of the present invention may be formed with one or more of the above-described features. The above aspects and features of the invention may be employed in any suitable combination as the present invention is not limited in this respect. It should also be appreciated that the drawings illustrate various components and features which may be incorporated into various embodiments of the present invention. For simplification, some of the drawings may illustrate more than one optional feature or component. However, the present invention is not limited to the specific embodiments disclosed in the drawings. It should be recognized that the present invention encompasses embodiments which may include only a portion of the components illustrated in any one drawing figure, and/or may also encompass embodiments combining components illustrated in multiple different drawing figures.

It should be understood that the foregoing description of various embodiments of the invention are intended merely to be illustrative thereof and that other embodiments, modifications, and equivalents of the invention are within the scope of the invention recited in the claims appended hereto.

What is claimed is:

1. Footwear comprising:

an upper constructed and arranged to support a top portion of a foot;

a tongue pivotally coupled to the upper, wherein the tongue is constructed and arranged to pivotally move relative to the upper between a first position and a second position; and at least one resilient member coupled to the tongue for urging the tongue in at least either the first position or the second position, wherein the at least one resilient member extends over the tongue from a medial side of the upper to a lateral side of the upper.

2. The footwear of claim 1, wherein the at least one resilient member is fixed at a first location on a medial side of the footwear, at a second location on the tongue, and at a third location on a lateral side of the footwear.

3. The footwear of claim 1, wherein the at least one resilient member comprises a first resilient member and a second resilient member.

4. The footwear of claim 1, further comprising a sole coupled to the upper and constructed and arranged to support a bottom portion of a foot.

5. The footwear of claim 1, wherein in the first position, the tongue extends substantially along an instep portion of the upper and in the second position the tongue extends substantially along a toe portion of the upper.

6. The footwear of claim 5, further comprising a closure system coupled to the instep portion of the upper to secure a foot within the upper.

7. The footwear of claim 6, wherein the tongue is constructed and arranged to substantially covers the closure system when the tongue is in the first position.

8. The footwear of claim 1, further comprising an attachment system for releasably coupling a portion of the tongue to a portion of the upper, the attachment system comprising:

a first attachment component coupled to the upper; and a second attachment component coupled to an underside of the tongue.

9. The footwear of claim 1, wherein the tongue is pivotally coupled to the upper along a pivot point, and wherein the pivot point is positioned proximate at least one of an instep portion of the upper and a toe portion of the upper.

10. The footwear of claim 1, wherein the tongue is made of a substantially rigid material such that the tongue remains substantially planar as it moves between the first position and the second position.

11. The footwear of claim 1, further comprising an adjustment mechanism to alter the angular orientation of the tongue with respect the upper when the tongue is in either the first position or the second position.

12. Footwear comprising:

an upper constructed and arranged to support a top portion of a foot;

a tongue pivotally coupled to the upper, wherein the tongue is constructed and arranged to pivotally move relative to the upper between a first position and a second position;

at least one resilient member coupled to the tongue for urging the tongue in at least either the first position or the second position, wherein the at least one resilient member comprises a first resilient member and a second resilient member; and wherein the first resilient member crosses the second resilient member when the tongue is in the first position.

13. The footwear of claim 12, wherein when the tongue is in the second position, the first and second resilient members are uncrossed.

14. Footwear comprising:

an upper constructed and arranged to support a top portion of a foot;

a sole coupled to the upper and constructed and arranged to support a bottom portion of a foot;

a spring-loaded tongue pivotally coupled to the upper, wherein the tongue is constructed and arranged to pivotally move relative to the upper between a first stable position and a second stable position, such that when the tongue is positioned in an intermediate position between the first and second position, the tongue will move towards at least either the first position or the second position.

15. The footwear of claim 14, further comprising at least one resilient member coupled to the tongue and at least one of the upper and sole, wherein movement of the at least one resilient member activates the spring-loaded tongue.

16. The footwear of claim 14, wherein in the first position, the tongue extends substantially along an instep portion of the upper and in the second position the tongue extends substantially along a toe portion of the upper.

17. The footwear of claim 16, wherein the tongue is constructed and arranged to spring towards the first position when the tongue is positioned in the intermediate position between the first position and the second position.

18. The footwear of claim 15, wherein the at least one resilient member comprises a first resilient member and a second resilient member.

19. The footwear of claim 15, wherein the at least one resilient member is fixed at a first location on a medial side of the footwear, at a second location on the tongue, and at a third location on a lateral side of the footwear.

20. The footwear of claim 14, further comprising an adjustment mechanism to alter the angular orientation of the tongue with respect the upper when the tongue is in either the first position or the second position.

21. The footwear of claim 14, further comprising a stiffening component adjacent a pivot axis of the tongue, wherein the stiffening component is configured to stabilize the tongue in the second position.

22. The footwear of claim 14, wherein the tongue is stable in the second position when the footwear is unworn.

23. Footwear comprising:

an upper constructed and arranged to support a top portion of a foot;

a sole coupled to the upper and constructed and arranged to support a bottom portion of a foot;

a spring-loaded tongue pivotally coupled to the upper, wherein the tongue is constructed and arranged to pivotally move relative to the upper between a first position and a second position, such that when the tongue is positioned in an intermediate position between the first and second position, the tongue will move towards at least either the first position or the second position;

at least one resilient member coupled to the tongue and at least one of the upper and sole, wherein movement of the at least one resilient member activates the spring-loaded tongue, wherein the at least one resilient member comprises a first resilient member and a second resilient member, and wherein the first resilient member crosses the second resilient member when the tongue is in the first position.

24. Footwear comprising:

an upper constructed and arranged to support a top portion of a foot;

a tongue pivotally coupled to the upper along a hinge, wherein the tongue is constructed and arranged to pivotally move relative to the upper between a first position where the tongue extends substantially along an instep portion of the upper and a second position where the tongue extends substantially along a toe portion of the upper; and at least one resilient member extending from a first fixed location on a medial side of the footwear to a second fixed location on the tongue and to a third fixed location on a lateral side of the footwear, and wherein as the tongue pivotally moves from the first position to the second position, the at least one resilient member pivotally moves over the hinge.

25. The footwear of claim 24, wherein the first fixed location on the medial side and the third fixed location on the lateral side are both positioned forward of the second fixed location on the tongue when the tongue is in the first position.

26. The footwear of claim 25, wherein the first fixed location on the medial side and the third fixed location on the lateral side are both positioned rearward of the hinge.

27. The footwear of claim 24, wherein the at least one resilient member comprises a first resilient member and a second resilient member.

28. The footwear of claim 24, further comprising a sole coupled to the upper and constructed and arranged to support a bottom portion of a foot.

29. Footwear comprising:

an upper constructed and arranged to support a top portion of a foot;

a tongue pivotally coupled to the upper about a hinge, wherein the tongue is constructed and arranged to pivotally move relative to the upper between a first position and a second position; and at least one resilient member coupled to the tongue for urging the tongue in at least either the first position or the second position, wherein the at least one resilient member is positioned along the hinge and adjacent one end of the tongue.

30. The footwear of claim 29, wherein the at least one resilient member includes a coil spring.

31. The footwear of claim 29, wherein the at least one resilient member includes a ratchet mechanism.

* * * * *